US005124217A

United States Patent [19]

Gruber et al.

[11] Patent Number: 5,124,217

[45] Date of Patent: Jun. 23, 1992

[54] MAGNETIC IMAGE CHARACTER RECOGNITION PROCESSES

[75] Inventors: Robert J. Gruber, Pittsford; Ronald J. Koch, Webster; Timothy J. Fuller, W. Henrietta, all of N.Y.

[73] Assignee: Xerox Corporation, Stamford, Conn.

[21] Appl. No.: 544,301

[22] Filed: Jun. 27, 1990

[51] Int. Cl.[5] ..... G03G 19/00; G03G 13/22; G03G 21/00

[52] U.S. Cl. ..... 430/39; 430/120; 430/122; 430/97

[58] Field of Search ..... 430/39, 120, 122, 97

[56] References Cited

U.S. PATENT DOCUMENTS

| | | | |
|---|---|---|---|
| 2,892,794 | 6/1959 | Insalaco . | |
| 3,049,077 | 7/1962 | Damm | 101/211 |
| 3,165,420 | 1/1965 | Tomanek et al. . | |
| 4,120,445 | 10/1978 | Carrier et al. . | |
| 4,230,787 | 10/1980 | Watanabe et al. | 430/122 X |
| 4,246,331 | 1/1981 | Mehl et al. | 430/106.6 |
| 4,296,192 | 10/1981 | Gruber et al. | 430/109 |
| 4,407,443 | 10/1983 | McCorkle | 383/5 |
| 4,517,268 | 5/1985 | Gruber et al. | 430/39 |
| 4,560,635 | 12/1985 | Hoffend et al. | 430/106.6 |
| 4,859,550 | 8/1989 | Gruber et al. | 430/39 |
| 4,883,736 | 11/1989 | Hoffend et al. | 430/110 |
| 4,960,664 | 10/1990 | Yamada et al. | 430/109 |
| 4,960,668 | 10/1990 | Yoshitomi et al. | 430/110 X |
| 4,990,425 | 2/1991 | Nanya et al. | 430/126 X |

*Primary Examiner*—Roland Martin
*Attorney, Agent, or Firm*—E. O. Palazzo

[57] ABSTRACT

An electrophotographic process for enabling substantially tamperproof images, including the generation of a latent image; developing the image with a toner composition comprised of resin particles, magnetite particles, and a colored organic soluble dye, a colored organic insoluble dye, or the salts thereof; and an optional additive component comprised of an aliphatic hydrocarbon or a polymeric alcohol of the formula $$CH_3(CH_2)_nCH_2OH$$

wherein n is a number of from about 30 to about 500.

37 Claims, No Drawings

MAGNETIC IMAGE CHARACTER RECOGNITION PROCESSES

BACKGROUND OF THE INVENTION

The present invention is generally directed to imaging processes with toner and developer compositions, and more specifically the present invention is directed to imaging and printing processes with toner compositions, including magnetic, single component, and two component, developer compositions particularly useful for generating documents, such as personal checks, which are subsequently processed in reader/sorters, and wherein there is avoided or minimized the tampering of the characters present thereon. Documents, including legal documents, such as personal checks, birth certificates, automobile licenses, identification papers, and the like have been tampered with, modified, altered, forged, and the like by, for example, attempting to delete, or modify characters present on these documents. For example, with personal checks the individuals name, address, and the character numbers appearing thereon can be unlawfully altered and utilized without detection. These and other disadvantages are avoided or minimized with the processes of the present invention. In one embodiment of the present invention, there are provided processes that enable one to easily detect the tampering, changing, modification, including forgery, and the like of documents, such as checks, including for example dividend checks, turn around documents, such as invoice statements like those submitted to customers by American Express and VISA, corporate checks, highway tickets, rebate checks, other documents with magnetic images and codes thereon obtained with a magnetic toner as illustrated herein, which toner has included therein a dye. The aforementioned dye causes a noticeable permanent color change on the document when, for example, altering is attempted with a solvent. More specifically, in one embodiment the process of the present invention is accomplished with toner and developer compositions comprised of a resin, magnetite, a black or highly colored dye, and optional components such as low molecular weight hydrocarbons containing functional groups such as hydroxy, amides, amines, esters, or polymeric alcohols as illustrated herein, and wherein image smearing and offsetting of the toner is avoided to read and write heads, including offsetting to the protective foil that may be present on the aforesaid heads in magnetic ink character recognition processes and apparatus inclusive of, for example, the read and write heads present in MICR (magnetic ink character recognition) reader/sorters such as the commercially available IBM 3890 TM, NCR 6780 TM, reader/sorters from Burroughs Corporation, and the like; and wherein modification, or alteration and the like is avoided, or minimized when solvents such as acetone, toluene, chloroform, and the like are selected. Accordingly, with the processes utilizing the toner and developer compositions illustrated the problems of document tampering, forgery, alteration, and the like are eliminated or minimized since the dye present in the toner causes a noticeable highly visible color change on the document, or character image when treated with a solvent thereby preventing the documents from being presented or accepted by others, such as banks, and the like. Moreover, in another embodiment the present invention is directed to improved economical processes for generating substantially tamper proof documents such as personal checks obtained, for example, by magnetic image character recognition methods, and wherein a magnetic toner with a dye is selected for generating the aforementioned documents. The toner compositions selected for the process of the present invention in an embodiment are comprised of resin particles, pigment particles, including magnetic components such as magnetites, dyes such as organic soluble dyes, including for example nigrosine, methylene blue, Sudan Blue, Rhodamine dye, and the like, and as optional components certain waxes such as those containing hydroxyl functionality. In addition, the present invention is directed to processes with developer compositions comprised of the aforementioned toners, and carrier particles. Further, the processes of the present invention with the toner and developer compositions illustrated, including single component toners, enable reliable output copy quality and stable triboelectric charging properties for the toner compositions selected.

Image and character tampering of documents as illustrated is avoided or minimized with the processes of the present invention since when the fused image or characters are brought into contact with solvents such as toluene there is immediately generated a colored stain, such as a bright violet stain with a Rhodamine dye. Also, with the processes of the present invention offset is eliminated or minimized, it is believed, because of the presence of the additives, reference U.S. Pat. No. 4,859,550, the disclosure of which is totally incorporated herein by reference. Offset results from, for example, the developed toner image being removed from the MICR (magnetic ink character recognition) document, such as a check to the read and/or write heads contained in MICR readers such as the IBM 3890 TM and the NCR 6780 TM. When the aforesaid offset is eliminated or substantially reduced, the problem of image smearing onto the MICR documents, such as personal checks, is also avoided. Apparently, although it is not desired to be limited by theory the additive, such as the polymeric alcohol, functions as a lubricant against offset according to the aforementioned '550 patent. By offset is meant, for example, that the toner is released from the document, such as personal checks and transfers and sticks to the aforementioned read and/or write heads. As a result, toner is removed from the checks or other documents as illustrated herein primarily in a continuous manner causing image smearing, and substantially preventing the characters on the checks from being read magnetically and thus rejected in most instances. With the processes of the aforementioned patent, these problems are avoided, and more specifically the reject rate is less than one half of 1 percent for 5,000 checks processed through, for example, in the aforesaid IBM 3890 TM reader/sorter 20 times (a reject amount of about 15 ). Thus, with the process of the above patent the reject rate is less than one half of 1 percent in embodiments thereof, it being noted that the acceptable reject rate usually does not exceed one half of 1 percent (0.5 percent), as determined by the American National Standards Institute (ANSI). Typically, the reject rate with the process of the above patent is from about 0.05 to about 0.3 percent depending, for example, on the sorter set up conditions as contrasted to a reject rate in excess of one half of 1 percent, which is not acceptable, with processes utilizing toner and developer compositions that contain, for example, no polymeric wax or other additives therein. With toner build up on the read/write heads, the excess toner is released to the check document being processed causing image smearing, which is avoided with the processes of the present invention.

With further respect to the present invention, the process is particularly applicable to avoiding or minimizing the unlawful modification of documents including personal checks, which have been fused with soft roll fusers. Fuser rolls, such as silicon rolls or other conformable fuser rolls, reference for example the soft fuser rolls incorporated into the Xerox Corporation 9700 TM machine, are particularly useful with the processes of the present invention.

The documents, including the personal checks mentioned herein, can be obtained, for example, by generating a latent image thereon and subsequently developing the image, reference U.S. Pat. No. 4,517,268, the disclosure of which is totally incorporated herein by reference, with the toner and developer compositions illustrated herein, which toner also contains a dye therein that changes to a noticeable color on the document when treated with a solvent. The developed image that has been created, for example, in the Xerox Corporation 9700 TM MICR printer, reference the aforesaid '268 patent, contains thereon, for example, the characters zero, 1, 2, 3, 4, 5, 6, 7, 8, and 9, and up to four symbols (E-13B and CMC-7 font), which characters are magnetically readable by the IBM 3890 TM, or other similar apparatus.

Developer and toner compositions with certain waxes therein are known. For example, there are disclosed in U.K. Patent Publication 1,442,835 toner compositions containing resin particles, and polyalkylene compounds, such as polyethylene and polypropylene of a molecular weight of from about 1,500 to 6,000, reference page 3, lines 97 to 119, which compositions prevent toner offsetting in electrostatic imaging processes. Additionally, the '835 publication discloses the addition of paraffin waxes together with or without a metal salt of a fatty acid, reference page 2, lines 55 to 58. In addition, many patents disclose the use of metal salts of fatty acids for incorporation into toner compositions, such as U.S. Pat. No. 3,655,374. Also, it is known that the aforementioned toner compositions with metal salts of fatty acids can be selected for electrostatic imaging methods wherein blade cleaning of the photoreceptor is accomplished, reference Palmeriti et al. U.S. Pat. No. 3,635,704, issued Jan. 18, 1972, the disclosure of which is totally incorporated herein by reference. Additionally, there are illustrated in U.S. Pat. No. 3,983,045 three component developer compositions comprising toner particles, a friction reducing material, and a finely divided nonsmearable abrasive material, reference column 4, beginning at line 31. Examples of friction reducing materials include saturated or unsaturated, substituted or unsubstituted, fatty acids preferably of from 8 to 35 carbon atoms, or metal salts of such fatty acids; fatty alcohols corresponding to said acids; mono and polyhydric alcohol esters of said acids and corresponding amides; polyethylene glycols and methoxypolyethylene glycols; terephthalic acids; and the like, reference column 7, lines 13 to 43.

Described in U.S. Pat. No. 4,367,275 are methods of preventing offsetting of electrostatic images of the toner composition to the fuser roll, which toner subsequently offsets to supporting substrates such as papers wherein there are selected toner compositions containing specific external lubricants including various waxes, see column 5, lines 32 to 45, which waxes are substantially different in their properties and characteristics than the polymeric alcohol waxes selected for the toner and developer compositions of the present invention; and moreover, the toner compositions of the present invention with the aforementioned polymeric alcohol additives possess advantages, such as elimination of toner spotting, not, it is believed, achievable with the toner and developer compositions of the '275 patent.

Disclosed in copending application U.S. Pat. No. 004,939 now U.S. Pat. No. 4,883,736, the disclosure of which is totally incorporated herein by reference, are toner compositions including magnetic single component, and colored toner compositions containing certain polymeric alcohol waxes. More specifically, there is disclosed in the aforementioned patent the elimination of toner spots or comets with developer compositions comprised of toner compositions containing resin particles, particularly styrene butadiene resins, pigment particles such as magnetites, carbon blacks or mixtures thereof, polymeric hydroxy waxes available from Petrolite, which waxes can be incorporated into the toner compositions as internal additives or may be present as external components, it being noted that with the processes of the present invention these additives are usually present as internal components; and optional charge enhancing additives, particularly, for example, distearyl dimethyl ammonium methyl sulfate, reference U.S. Pat. No. 4,560,635, the disclosure of which is totally incorporated herein by reference, and carrier particles. As preferred carrier components for the aforementioned compositions, there are selected steel or ferrite materials, particularly with a polymeric coating thereover, including the coatings as illustrated in U.S. Pat. No. 751,922 (now abandoned), entitled Developer Composition with Specific Carrier Particles, the disclosure of which is totally incorporated herein by reference. One particularly preferred coating illustrated in the aforementioned copending application is comprised of a copolymer of vinyl chloride and trifluorochloroethylene with conductive substances dispersed in the polymeric coating inclusive of, for example, carbon black. One embodiment disclosed in the aforementioned abandoned application is a developer composition comprised of styrene butadiene copolymer resin particles, and charge enhancing additives selected from the group consisting of alkyl pyridinium halides, ammonium sulfates, and organic sulfate or sulfonate compositions; and carrier particles comprised of a core with a coating of vinyl copolymers, or vinyl homopolymers. The polymeric components of the aforesaid application are also selected for various embodiments of the present invention as illustrated herein.

In a Petrolite, Inc. brochure, dated 1985 there are disclosed polymeric hydroxy waxes, which brochure indicates that the waxes may have utility as toner.

In U.S. Pat. No. 4,517,268, and U.S. Pat. No. Re. 33,172, the disclosures of which are totally incorporated herein by reference, there is illustrated a process for generating documents such as personal checks suitable for magnetic image character recognition, which process involves generating documents in high speed electronic laser printing devices. The developer composition disclosed in this patent is comprised of, for example, magnetic particles, such as magnetite, certain styrene resin particles, and the carrier particles as illustrated in the Abstract of the Disclosure. Additive particles may also be included in the developer compositions of this patent. One object of the present invention is to provide toners and proceses whereby alteration, modification, tampering, including unlawful tampering, and the like are avoided or minimized with the toners and developers of the aforementioned patent that also contain a dye as illustrated herein.

Moreover, toner and developer compositions containing charge enhancing additives, especially additives which impart a positive charge to the toner resin, are well known. Thus, for example, there is described in U.S. Pat. No. 3,893,935 the use of certain quaternary ammonium salts as charge control agents for electrostatic toner compositions. There is also described in U.S. Pat. No. 2,986,521 reversal developer compositions comprised of toner resin particles coated with finely divided colloidal silica. According to the disclosure of this patent, the development of images on negatively charged surfaces is accomplished by applying a developer composition having a positively charged triboelectric relationship with respect to the colloidal silica. Further, there is illustrated in U.S. Pat. No. 4,338,390, the disclosure of which is totally incorporated herein by reference, developer and toner compositions having incorporated therein as charge enhancing additives organic sulfate and sulfonate compositions; and in U.S. Pat. No. 4,298,672, the disclosure of which is totally incorporated herein by reference, positively charged toner compositions containing resin particles and pigment particles, and as a charge enhancing additive alkyl pyridinium compounds, inclusive of cetyl pyridinium chloride.

Other prior art disclosing positively charged toner compositions with charge enhancing additives include U.S. Pat. No. 3,944,493; 4,007,293; 4,079,014 and 4,394,430.

Although the above described toner and developer compositions are useful for their intended purposes, there is a need for improved compositions. More specifically, there is a need for processes enabling the generation of documents, such as personal checks, with single and two component toner and developer compositions wherein character tampering, alteration, removal, forgery, and the like are eliminated in an embodiment of the present invention. There is also a need for the generation of developed images including the generation of personal checks in laser printers utilizing magnetic ink character recognition technology, wherein character tampering, alteration, removal, and the like are eliminated or minimized in an embodiment of the present invention, and wherein toner offset to protective foils present on the read and write heads is avoided, and image smearing is eliminated by adding to the toner, preferably as an internal additive, low molecular weight, less than about 20,000 weight average, aliphatic hydrocarbons; and especially polymeric alcohols. In addition, there is a need for MICR processes for generating documents such as personal checks with toner and developer compositions that maintain their triboelectrical characteristics for extended time periods exceeding, for example, 450,000 developed images, and wherein image tampering can be minimized.

SUMMARY OF THE INVENTION

It is a feature of the present invention to provide toner and developer compositions, processes for obtaining images thereof, and particularly processes for avoiding or minimizing the tampering modification, forgery, and the like of images, or characters present, for example, on documents such as personal checks.

Another feature of the present invention resides in the provision of processes for generating documents, such as personal checks, suitable for magnetic ink character recognition, which processes utilize toner and developer compositions containing dyes therein.

Another feature of the present invention resides in the provision of processes for eliminating or minimizing the unlawful alteration of legal documents such as personal checks, birth certificates, drivers licenses, pilot licenses, other identification documents, and the like.

In another feature of the present invention there are provided processes for generating documents, such as personal checks, suitable for magnetic ink character recognition, which processes utilize toner and developer compositions containing dyes, and aliphatic hydrocarbons without functional groups, and with functional groups or polymeric hydroxy waxes wherein image and character tampering is avoided, or minimized.

Moreover, another feature of the present invention relates to processes wherein image and character tampering are avoided or minimized with a toner by the development of the aforementioned images and the like with a toner containing a highly colored organic soluble dye.

In another feature of the present invention, there are provided processes for processing documents wherein offsetting and image smearing are avoided.

Also, in another feature of the present invention there are provided processes wherein, for example, image smearing and toner offsetting is avoided when documents, such as checks, containing magnetic characters thereon are utilized in commercial sorters, and/or readers/sorters, and wherein the formed images or characters can not be removed or altered without causing a noticable highly visable color stain to appear.

Additionally, in yet another feature of the present invention there are provided magnetic ink character recognition processes (MICR), which processes are suitable for the generation of documents with toner and developer compositions containing dyes, and polymeric alcohols, and wherein these documents can be utilized in commercial sorters, and/or reader/sorters such as the IBM 3890 TM without toner offsetting and image smearing as illustrated herein, and wherein the characters on the documents, such as checks, cannot be tampered with or altered.

In another feature of the present invention, there are provided processes for generating documents, such as personal checks, suitable for magnetic image character recognition, which processes utilize toner and developer compositions and wherein the characters present on the documents are fused with a soft fuser roll, and wherein there is avoided the tampering, modification, and the like of characters thereon, which when treated with a solvent to effect tampering, causes the image or character of the document to stain or charge to a permanent noticeable color.

In yet another feature of the present invention, there are provided processes wherein one can detect attempts to alter images, particularly characters present on personal checks, with a solvent by utilizing for developing a toner with a dye therein, especially a highly colored organic soluble dye or dyes.

These and other features of the present invention can be accomplished in embodiments of the present invention by providing processes with developer compositions and toner compositions that are useful for generating documents inclusive of personal checks, which documents can be subsequently processed in reader/sorter devices as illustrated herein. More specifically, the present invention is directed to processes for generating substantially tamperproof documents, which comprise the formation of images, such as latent images with a printing device especially devices generating from about 8 to about 135 prints per minute; developing the image with a single, or two component developer composition (toner+carrier) as illustrated herein, which compositions contain, for example, resin particles, pigments such as magnetite particles, highly colored organic insoluble or organic soluble dyes, and optional additives such as low molecular weight hydrocarbons with functional groups or the polymeric alcohols illustrated herein; subsequently transferring the developed image to a suitable substrate; and permanently affixing the image thereto. When the aforementioned documents are treated with solvents capable, for example, of dissolving the characters or images present on the documents, a permanent highly visible color change takes place on the document, which can render the document unusable, or wherein alteration of the document is detectable in view of the color stain present thereon. Examples of MICR process wherein a toner with no dye, and hydrocarbon or polymeric alcohol additive is selected, is illustrated in U.S. Pat. No. 4,517,268, the disclosure of which is totally incorporated herein. Examples of high speed electronic printing devices disclosed in the aforementioned patent, which devices can also be utilized for the process of the present invention, include the 8700 TM, and 9700 TM MICR printer available from Xerox Corporation. More specifically, there can be selected for the generation of the documents with magnetic characters thereon the Xerox Corporation 9700 TM MICR printer about 120 prints per minute, the Xerox Corporation 8700 TM MICR printer, about 80 prints per minute, and the like. Also, there can be selected for the processes of the present invention other devices including ionographic printers such as the Delphax 4060 TM printers, the Xerox Corporation 4040 TM, which contains a soft fuser, roll for fixing purposes, and the Xerox Corporation 4045 TM and 4050 TM.

In one embodiment of the present invention, there is selected for the development and generation of check characters or other images a toner comprised of a resin, pigment such as magnetite, a highly colored organic soluble dye, or an organic insoluble, that is soluble or insoluble in the toner resin, such as nigrosine, Rhodamine dye, and the like. Although it is not desired to be limited by theory, it is believed that the dye present in the toner changes to a highly visible color when treated with a solvent, and this color or color stain can render the document unusable, or the document will be recognized as a forgery when it is presented.

In another embodiment of the present invention, there is provided a process for providing tamperproof or tamper resistant documents, which comprises the generation of a latent image and developing the latent image with a toner composition comprised of resin particles, pigment particles, magnetic particles, such as magnetite, a highly colored organic soluble or insoluble dye, such as nigrosine, and the like, and an additive component comprised of an aliphatic hydrocarbon, or polymeric alcohols of the formula $$CH_3(CH_2)_nCH_2OH$$

wherein n is a number of from about 30 to about 500, and preferably about 300. Another embodiment of the present invention is directed to an electrophotographic process for obtaining tamperproof, or tamper resistant images, which comprises the generation of a latent image in an electronic printing device; thereafter developing the characters with a toner composition comprised of resin particles, pigment particles, magnetite particles, a highly colored organic soluble dye, such as nigrosine, and the like; and an additive component comprised of an aliphatic hydrocarbon or polymeric alcohols of the formula $$CH_3(CH_2)_nCH_2OH$$

wherein n is a number of from about 30 to about 300, and subsequently processing the documents with magnetic characters thereon in reader/sorters.

The toner compositions selected for the process of the present invention are comprised of resin particles, magnetites, highly colored dyes, optional pigment particles, such as carbon black and optional aliphatic hydrocarbons containing functional groups, such as polymeric alcohols with hydroxyl functionality. In one embodiment of the present invention, there are selected for the process of the present invention toner compositions comprised of resin particles, magnetite particles, highly colored dyes, optional pigment particles, charge enhancing additives, and certain optional polymeric alcohol waxes, which waxes are available from Petrolite Corporation. Furthermore, there are provided in accordance with the present invention processes with positively or negatively charged toner compositions comprised of resin particles, pigment particles, magnetite particles, highly colored dyes, and charge enhancing additives. Another embodiment of the present invention is directed to processes with developer compositions comprised of the aforementioned toners; and carrier particles. Additionally, the toner compositions selected may include as additives, preferably external additives, in amounts, for example, of from about 0.1 to about 1.0 percent, and preferably 0.5 percent by weight of silica such as Aerosil R972 ®, metal salts, metal salts of fatty acids such as zinc stearate, and the like, reference U.S. Pat. Nos. 3,720,617; 3,900,588 and 3,590,000, the disclosures of which are totally incorporated herein by reference.

Illustrative examples of suitable toner resins selected for the toner and developer compositions and present in various effective amounts, providing the total amount of all components is equal to about 100 percent by weight, such as, for example, from about 35 percent by weight to about 90 percent by weight, include polyesters, polyamides, epoxy resins, polyurethanes, polyolefins, vinyl resins and polymeric esterification products of a dicarboxylic acid, and a diol comprising a diphenol. Various suitable vinyl resins may be selected as the toner resin including homopolymers or copolymers of two or more vinyl monomers. Typical vinyl monomeric units include styrene, p-chlorostyrene, unsaturated mono-olefins such as ethylene, propylene, butylene, isobutylene, and the like; vinyl chloride, vinyl bromide, vinyl fluoride, vinyl acetate, vinyl propionate, vinyl benzoate, and vinyl butyrate; vinyl esters such as esters of monocarboxylic acids including methyl acrylate, ethyl acrylate, n-butylacrylate, isobutyl acrylate, dodecyl acrylate, n-octyl acrylate, 2-chloroethyl acrylate, phenyl acrylate, methylalpha-chloroacrylate, methyl methacrylate, ethyl methacrylate, and butyl methacrylate; acrylonitrile, methacrylonitrile, and acrylamide; vinyl ethers such as vinyl methyl ether, vinyl isobutyl ether, and vinyl ethyl ether. Styrene butadiene copolymers, especially styrene butadiene copolymers prepared by a suspension polymerization process, reference U.S. Pat. No. 4,558,108, the disclosure of which is totally incorporated herein by reference; crosslinked polymers; polymers with a low molecular weight wax, such as a polyethylene or polypropylene with a weight average molecular weight of from about 1,000 to about 6,000; and mixtures thereof can be selected as the toner resin.

As one toner resin there can be selected the esterification products of a dicarboxylic acid and a diol comprising a diphenol, which components are illustrated in U.S. Pat. No. 3,590,000, the disclosure of which is totally incorporated herein by reference. Other specific toner resins include styrene/methacrylate copolymers, styrene/acrylate copolymers, and styrene/butadiene copolymers, especially those as illustrated in the aforementioned patent; and styrene butadiene resins with high styrene content, that is exceeding from about 80 to 85 percent by weight of styrene, which resins are available as Pliolites from Goodyear Chemical Company; polyester resins obtained from the reaction of bisphenol A and propylene oxide, followed by the reaction of the resulting product with fumaric acid; and branched polyester resins resulting from the reaction of dimethylterephthalate, 1,3-butanediol, 1,2-propanediol, and pentaerythritol.

Examples of magnetites selected for the toner and developer compositions utilized for the process of the present invention include those commercially available, such as Mapico Black, which magnetites are generally present in the toner composition in an amount of from about 25 percent by weight to about 70 percent by weight, and preferably in an amount of from about 30 percent by weight to about 60 percent by weight. Alternatively, there can be selected mixtures of magnetites with pigment particles such as carbon black or equivalent pigments, which mixtures, for example, contain from about 35 percent to about 60 percent by weight of magnetite, and from about 0.5 percent to about 10 percent by weight of carbon black. Also, there may be selected hard, or acicular magnetites in amounts of from about 15 to about 40, and preferably from about 20 to about 30 percent by weight. Examples of hard magnetites include MO4232 available from Pfizer Chemical.

Examples of colored organic soluble and insoluble dyes, present in effective amounts of, for example, from about 0.1 to about 15 weight percent, and preferably from about 1 to about 5 weight percent include Rhodamine, nigrosine, methylene blue, Sudan Blue, red dyes, green dyes, and the like.

Typical examples of classes of dyes and specific dyes include azos, acridine dyes, azine dyes, metallized azomethine dyes, methine dyes, oxazine dyes, quinoline dyes, thiazine, triarylmethane dyes, triphenodioxazine dyes, anthraquinone dyes, indigoid dyes, for example, Congo Red, Induline 6B Cl 860, Celliton Fast Yellow 7G, Cyanine Cl 806, Pinacyanol Cl 808, Meldola's Blue Cl 909, Toluylene Blue Cl 820, Methylene Green B Cl 924, Paraosaniline Cl 676, Rhodamine 3GO, Brilliant Milling Green B Cl 667, Scarlet Cl 1034, Algol Brilliant Green BK, Quinoline Yellow O Cl 801, and the like.

Illustrative examples of optional charge enhancing additives present in various effective amounts such as, for example, from about 0.05 to about 10 percent by weight, and more preferably from about 0.5 to about 2 percent by weight, and enabling positively charged toner compositions with a triboelectric charge, for example, of from about 15 to about 40 microcoulombs per gram include alkyl pyridinium halides, such as cetyl pyridinium chlorides, reference U.S. Pat. No. 4,298,672, the disclosure of which is totally incorporated herein by reference; cetyl pyridinium tetrafluoroborates, quaternary ammonium sulfate, and sulfonate charge control agents as illustrated in U.S. Pat. No. 4,338,390, including stearyl phenethyl dimethyl ammonium tosylates, reference U.S. Pat. No. 4,338,390, the disclosure of which is totally incorporated herein by reference; distearyl dimethyl ammonium methyl sulfate, reference U.S. Pat. No. 4,560,635, the disclosure of which is totally incorporated herein by reference; stearyl dimethyl hydrogen ammonium tosylate; and other known similar charge enhancing additives; and the like. Examples of charge enhancing additives present in various effective amounts, such as, for example, from about 0.05 to about 10 percent by weight, and preferably from about 1 to about 5 percent by weight, and more preferably from about 0.5 to about 2 weight percent that enable negatively charged toners with a triboelectric charge, for example, of from about −15 to about −40 microcoulombs per gram include Spilon TRH available from Hodogaya Chemical, orthohalophenylcarboxylic acids, reference U.S. Pat. No. 4,411,974, the disclosure of which is totally incorporated herein by reference, potassium tetraphenyl borates, and the like.

With further respect to the toner and developer compositions for the processes of the present invention there may be selected as an external or internal additive aliphatic hydrocarbon waxes, such as the Bareco's (Polywaxes) which are believed to be low molecular weight polyethylenes available from Petrolite Corporation, or linear polymeric alcohols comprised of a fully saturated hydrocarbon backbone with at least about 80 percent of the polymeric chains terminated at one chain end with a hydroxyl group, which alcohol is represented by the following formula:

$$CH_3(CH_2)_nCH_2OH$$

wherein n is a number of from about 30 to about 500, preferably of from about 30 to about 300, and more preferably from about 30 to about 100, which alcohols are available from Petrolite Corporation. Particularly preferred polymeric alcohols include those wherein n represents a number, of from about 30 to about 100, and preferably about 40 to about 70. Therefore, in an embodiment of the present invention the polymeric alcohols selected have a number average molecular weight as determined by gas chromatography of from about greater than 450 to about 1,400, and preferably of from about 475 to about 750. In addition, the aforementioned polymeric alcohols are present in the toner and developer compositions illustrated herein in various effective amounts, and are usually added as uniformly dispersed internal additives. More specifically, the polymeric alcohols are present in an amount of from about 1 percent to about 20 percent by weight. Therefore, for example, as internal additives the polymeric alcohols are preferably present in an amount of from about 1 percent by weight to about 8 percent by weight, while as external additives in a less preferred embodiment the polymeric alcohols may be present in an amount of from about 0.5 percent by weight to slightly less than about 5 percent by weight. Toner and developer compositions with the waxes present internally are formulated by initially blending the toner binder resin particles, pigment particles, and polymeric alcohols, and other optional components. In contrast, when the polymeric alcohols are present as external additives, the toner composition is initially formulated comprised of, for example, resin particles and pigment particles; and subsequently there is added thereto finely divided polymeric alcohols.

Although it is not desirable to be limited by theory, it is believed that the aforementioned linear polymeric alcohols possess very narrow polydispersity, that is the ratio of $M_w/M_n$ is equal to or less than about 1:1 in one embodiment; and moreover, these alcohols possess high crystallinity with a density of about 0.985. By high crystallinity is meant that the linear polymeric alcohol molecular chains possess a high degree of molecular order in their solid state molecular structure; and also possess zero to very few defects in this ordered molecular structure, and exhibit a sharp primary transition or melting point, reference for example the text *Macromolecule Structure and Properties*, Vol. 1, authored by Hans Georg Elias (1984), particularly Chapter 5, pages 151 to 154. Accordingly, it is believed that the waxes selected for the present invention especially those encompassed by the formula illustrated herein possess properties that are unique for polymeric waxes inclusive of substantially complete saturation, high linearity, crystallinity, narrow molecular weight distributions, and primary alcohol functionality, or no functionality in some instances. In addition, these waxes possess the appropriate hardness and toughness properties enabling the resulting toner and developer compositions to be readily attritable to fine particle sizes of less than, for example, about 15 micrometers average diameter.

Illustrative examples of carrier particles that can be selected for mixing with the toner compositions, thus permitting two component developers that can be selected for the process of the present invention, include those particles that are capable of triboelectrically obtaining a charge of opposite polarity to that of the toner particles. Accordingly, the carrier particles can be selected to be of a negative polarity thereby enabling the toner particles which are positively charged to adhere to and surround the carrier particles. Alternatively, there can be selected carrier particles with a positive polarity enabling toner compositions with a negative polarity. Illustrative examples of carrier particles that may be selected include steel, nickel, iron, ferrites, and the like. Additionally, there can be selected as carrier particles nickel berry carriers as disclosed in U.S. Pat. No. 3,847,604, which carriers are comprised of nodular carrier beads of nickel characterized by surfaces of reoccurring recesses and protrusions thereby providing particles with a relatively large external area. In one embodiment, carrier particles selected for the present invention are comprised of a magnetic, such as steel, core with a polymeric coating thereover several of which are illustrated, for example, in U.S. Ser. No. 751,922 (now abandoned) relating to developer compositions with certain carrier particles, the disclosure of which is totally incorporated herein by reference. More specifically, there are illustrated in the aforementioned abandoned application carrier particles comprised of a core with a coating thereover of vinyl polymers, or vinyl homopolymers. Examples of specific carriers illustrated in the abandoned application, and particularly useful for the present invention are those comprised of a steel or ferrite core with a coating thereover of a vinyl chloride/trifluorochloroethylene copolymer, which coating contains therein conductive particles, such as carbon black. Other coatings include fluoropolymers, such as polyvinylidenefluoride resins, poly(chlorotrifluoroethylene), fluorinated ethylene and propylene copolymers, terpolymers of styrene, methylmethacrylate, and a silane, such as triethoxy silane, reference U.S. Pat. Nos. 3,467,634 and 3,526,533, the disclosures of which are totally incorporated herein by reference; polytetrafluoroethylene, fluorine containing polyacrylates, and polymethacrylates; copolymers of vinyl chloride and trichlorofluoroethylene; and other known coatings. There can also be selected as carriers components comprised of a core with a plurality of polymers coating thereover, reference U.S. Pat. Nos. 4,937,166 and 4,935,326, the disclosures of which are totally incorporated herein by reference. More specifically, there is detailed in these patents a process for the preparation of carrier particles with substantially stable conductivity parameters which comprises (1) mixing carrier cores with a polymer mixture comprising from about 10 to about 90 percent by weight of a first polymer, and from about 90 to about 10 percent by weight of a second polymer; (2) dry mixing the carrier core particles and the polymer mixture for a sufficient period of time enabling the polymer mixture to adhere to the carrier core particles; (3) heating the mixture of carrier core particles and polymer mixture to a temperature of between about 200° F. and about 550° F. whereby the polymer mixture melts and fuses to the carrier core particles; and (4) thereafter cooling the resulting coated carrier particles.

Also, while the diameter of the carrier particles can vary, generally they are of a diameter of from about 50 microns to about 1,000 microns, thus allowing these particles to possess sufficient density to avoid adherence to the electrostatic images during the development process. The carrier particles can be mixed with the toner particles in various suitable combinations, however, in an embodiment about 1 to about 5 parts per toner to about 10 parts to about 200 parts by weight of carrier are mixed. Also, the polymer carrier coating weight can vary, however, generally from about 0.1 to about 5 and preferably from about 0.1 to about 3.0 weight percent of coating is selected.

The toner compositions illustrated herein can be prepared by a number of known methods, including mechanical blending and melt blending the toner resin particles, pigment particles such as magnetite, highly colored dye, and optional polymeric alcohols followed by mechanical attrition. Other methods include those well known in the art such as spray drying, mechanical dispersion, melt dispersion, dispersion polymerization, and suspension polymerization. More specifically, the toner compositions can be prepared by the simple mixing of polymeric resin, magnetite, highly colored dye, and other components while heating in a Banbury device, followed by cooling, micronization and classification to enable toner particles of, for example, an average diameter of from about 10 to about 25 microns, and preferably from about 10 to about 15 microns. Classification is accomplished primary for the purpose of removing fines, that is, for example, particles with a diameter of 5 microns or less, and very large course particles, that is with a diameter of greater than 30 microns. Also, the aforementioned toners can be prepared in a similar manner with an extrusion device wherein the product exiting from such a device is severed into pieces followed by micronization and classification.

As indicated herein, the toner and developer compositions of the present invention may be selected for use in developing images in electrophotographic imaging systems, containing therein, for example, conventional photoreceptors, such as selenium and selenium alloys. Also useful, especially wherein there is selected positively charged toner compositions, are layered photoresponsive devices comprised of transport layers and photogenerating layers, reference U.S. Pat. Nos. 4,265,990; 4,585,884; 4,584,253 and 4,563,408, the disclosures of which are totally incorporated herein by reference, and other similar layered photoresponsive devices. Examples of photogenerating layers include selenium, selenium alloys, trigonal selenium, metal phthalocyanines, metal free phthalocyanines, and vanadyl phthalocyanines, while examples of charge transport layers include the aryl amines as disclosed in U.S. Pat. No. 4,265,990. Moreover, there can be selected as photoconductors hydrogenated amorphous silicon, and as photogenerating pigments squarines, perylenes, titanyl phthalocyanine, and the like.

One developer composition of the present invention is comprised of a toner composition with styrene butadiene resin particles (91/9), 69 weight percent, about 28 percent by weight of magnetite, available as MO4232, and about 3 percent by weight of Rhodamine dye; and carrier particles comprised of a steel core with a coating thereover of a polymer of, for example, a vinyl chloride/trifluorochloroethylene copolymer available as FPC 461, which coating has dispersed therein conductive components such as carbon black particles.

As preferred magnetites selected for the toner compositions for the processes of the present invention, in embodiments thereof the magnetites as illustrated in U.S. Pat. No. 4,517,268, the disclosure of which is totally incorporated herein by reference, are utilized.

Illustrative examples of aliphatic hydrocarbons that may be selected as additives in place of the polymeric alcohols, include CeraLube 54, an amide modified polypropylene wax available from Shamrock Chemical Company; Ceralube 363, a modified polyethylene wax available from Shamrock Chemical Company; Bareco 500, 1,000, and 2,000, low molecular weight polyethylenes with, it is believed, no functional groups, available from Petrolite, Inc., and the like. Preferred polymeric alcohols, which are available from Petrolite, include Unilin 700, 1,000 and 2,000.

With further respect to the present invention, there is provided in specific embodiments a process, including a xerographic process which comprises generating a latent image; developing the image which contains magnetic characters thereon, such as personal checks and the other documents illustrated herein with a toner composition comprised of resin particles, magnetic particles, and highly colored dye; and thereafter processing the documents obtained in a reader/sorter and a xerographic process which comprises forming a latent image on an imaging member; developing the image with a toner composition comprised of resin particles and pigment partricles; subsequently transferring the image to a suitable substrate; subsequently permanently affixing the image by, for example, heating or a combination of heating and pressure; and thereafter, applying a solvent to the developed image whereby staining of the image results.

Solvents that can be selected in an attempt to alter the image, or characters include ethers, ketones, alcohols, aromtaic solvents, halogenated, especially chlorinated solvents such as chlorofrom, methylene chloride, Freons, acetic acid, ethanol, methanol, propanol, phenol, benzene, toluene, and the like.

Also, other methods may be selected to alter the image, or characters present on documents, including for example removing the image by wetting with water, and the like.

The following examples are being submitted to further define various species of the present invention. These examples are intended to illustrate and not limit the scope of the present invention. Also, parts and percentages are by weight unless otherwise indicated.

EXAMPLE I

There was prepared in a Banbury device by melt blending with heating, followed by mechanical attrition, a toner composition comprised of 62 percent by weight of a styrene butadiene resin with 91 percent by weight of styrene and 9 percent by weight of butadiene, 28 percent by weight of the magnetite MO 4232, which toner had incorporated as an internal component 7 weight percent of a linear polymeric alcohol, available from Petrolite Corporation, of the formula as illustrated herein with a number average molecular weight of about 700, that is where n is a number of about 48 as determined by gas chromophotography, and 3 percent of Rhodamine red dye, which toner had an average particle size diameter of 10 micrometers after classification. Also included on the surface of the toner was 0.3 percent by weight of Aerosil R972.

The aforementioned toner composition had a triboelectric charge thereon of a minus −15.5 microcoulombs per gram with the following carrier as determined by the known Faraday Cage apparatus.

Subsequently, there was prepared a developer composition by admixing the aforementioned formulated toner composition at a 4.5 percent toner concentration, that is 4.5 parts by weight of toner per 100 parts by weight of carrier, which carrier was comprised of a ferrite core, available from Titan Corporation, with a 0.6 weight percent polymeric coating, 80 percent by weight thereover of a terpolymer of styrene, methylmethacrylate, and triethoxy silane containing 20 percent by weight of Vulcan XC72R carbon black available from Pfizer, reference U.S. Pat. No. 4,517,268, the disclosure of which is totally incorporated herein by reference.

The aforementioned developer composition was utilized to develop latent images generated in the Xerox Corporation 9700 TM MICR apparatus, commercially available, which images were fused with a hard roll fuser, resulting in personal checks with magnetic characters thereon.

Methyl ethyl ketone solvent was then applied with an eye dropper to the above generated check documents or characters thereon, and they were converted to a violet color, which was permanent and highly visible, thus if one attempted to alter or forge the above documents with a solvent the forgey would be unusable or would be easily detectable as a forgery when presented in view of the violet color.

Substantially similar results were obtained with a toner comprised of 3 percent Rhodamine red dye, 28 percent of magnetite MO4232, and 69 percent of styrene butadiene (91/9) and no polymeric alcohol.

When the above checks formed with the toner with the polymeric alcohol prior to the application of the solvent, about 5,000, were utilized in the IBM 3890 TM with a reader/sorter, toner offsetting to the protective foils present on the read and write heads was minimized as evidenced by visual observation, and image smearing did not result on the final images as determined by visual observation. More specifically, 5,000 of the aforementioned created checks were passed through an IBM 3890 TM sorter 20 times, and the reject rate, that is where the magnetic image, characters could not be read, was 0.1 percent or 5 beginning with the first pass and continuing up to the 20th pass, and image smearing was avoided. Thus, out of a total of 100,000 checks processed in the aforesaid reader/sorter only 5 were rejected. When repeating the aforementioned process with the exception that there was selected a toner and developer composition without the linear polymeric alcohol available from Petrolite Corporation, the protective foil on the read/write heads was contaminated with toner; it being noted that less toner contamination resulted on the aforesaid foils when the same toner and developer were utilized containing the linear polymeric alcohol wax available from Petrolite. When the above process was repeated in the NCR 6780 TM, which contains no protective foils on the read and write heads, less toner contamination was noted on the read and write heads as with the toner and developer containing the polymeric alcohol compared to the utilization of a toner containing no linear polymeric alcohol. In view of this, it is believed that machine maintenance can be reduced since there is less toner contamination present.

Also, similar toner and developer compositions can be prepared and utilized for generating and utilizing checks with substantially similar desirable offsetting and image smearing results, and wherein the polymeric alcohol can be present in an amount of from about 2 to about 15, and preferably from about 4 to about 6.9 percent by weight.

Further, there were prepared similar toner and developer compositions with the exceptions that there was selected in place of the polymeric alcohol Bareco 1000, a polyethylene available from Petrolite Chemical. When checks formed with the aforementioned developer compositions were utilized in the IBM 3890 TM as illustrated above, the reject rate was less than 0.08 percent. Toner offsetting to the read and write heads was avoided as evidenced by visual observation, and image smearing did not results as determined by visual observation. Also, when methyl ethyl ketone solvent was applied with an eye dropper to the above generated check documents or characters thereon they were converted to a violet color, which was permanent and highly visible, thus if one attempted to alter or forge the above documents with a solvent the forgery would be unusable or would be easily detectable as a forgery when presented in view of the violet color.

EXAMPLE II

The process of Example I was repeated with the exceptions that the resin was present in an amount of 69 weight percent, and no wax was selected. Substantially similar results were obtained. More specifically, when methyl ethyl ketone solvent was applied with an eye dropper to the above generated check documents or characters thereon they were converted to a violet color, which was permanent and highly visible, thus if one attempted to alter or forge the above documents with a solvent the forgery would be unusable or would be easily detectable as a forgery when presented in view of the violet color.

EXAMPLE III

A positively charged toner composition with a triboelectric charge thereon of 18 microcoulombs per gram was prepared by repeating the procedure of Example I with the exceptions that 26 percent of the magnetite, 3 percent of the polymeric alcohol component (Unilin 700), 1 percent by weight of the charge enhancing additive distearyl dimethyl ammonium methyl sulfate and 70 percent of styrene butadiene resin were selected. A developer composition was then prepared by repeating the procedure of Example I with the exception that the carrier particles were comprised of a core of Toniolo steel with a double dry powder coating thereover comprised of 50 percent by weight of polymethylmethacrylate, and 50 percent by weight of Kynar, a polyvinylidene fluoride available from Petrolite, at a coating weight of 0.7 percent.

Personal checks were then generated in the Xerox 9700 TM, wherein fixing of the developed images was accomplished with a soft silicone roll, and these checks were subsequently utilized (sorted) in the IBM 3890 TM by repeating the procedure of Example I, and substantially similar results were obtained, that is toner offsetting (contamination) to the read and write heads was substantially avoided as evidenced by visual observation, and image smearing did not result on the final images as determined by visual observation for 100,000 checks. The reject rate was 0.32 percent.

Also, when methyl ethyl ketone solvent was applied with an eye dropper to the above generated check documents they were converted to a violet color, which was permanent and highly visible, thus if one attempted to alter or forge the above documents with a solvent the forgery would be unusable or would be easily detectable as a forgery when presented in view of the violet color.

EXAMPLE IV

A toner was prepared by first melt mixing and dispersing in a Banbury device and rubber mill the following components, 52.5 weight percent of styrene-butylacrylate resin with a styrene to acrylate ratio of 86:14, an average molecular weight of 300,000 and glass transition temperature of 65° F., 30 weight percent of Mapico Black magnetite, 10 weight percent of Pfizer MO4232 magnetite, 6 weight percent of crystalline polyethylene wax of about 2,000 weight average molecular weight available from Petrolite Corporation, 0.5 weight percent of methylene blue, and 1.0 weight percent of Spilon Black TRH charge additive. After melt blending, the above mixture was converted to toner by known mechanical grinding then air attrition to 11 micron average diameter toner. After classification to 10 microns, the resultant toner was surface treated with 0.8 weight percent Aerosil R972 in a high energy powder mill to improve powder flow and tribo charging properties.

The above prepared mono component toner, when used in a Xerox Corporation 4030 TM printer to produce checks with MICR characters provided a permanent blue-violet stain on the paper when the xerographically produced characters were tampered with, treated with or contacted with by solvents such as methyl ethyl ketone, xylene or alcohols.

Other modifications of the present invention may occur to those skilled in the art subsequent to a review of the present application. The aforementioned modifications, including equivalents thereof, are intended to be included within the scope of the present invention.

What is claimed is:

1. An electrophotographic process for enabling documents that are resistant to tampering, or wherein tampering can be substantially avoided, which comprises the generation of a latent image; developing the image with a toner composition comprised of resin particles, magnetite particles, and a colored organic soluble dye, or a colored organic insoluble dye, which dye is selected from the group consisting of Rhodamine red dye and Methylene Blue dye; and contacting the developed image with a solvent thereby resulting on the document a permanent visible color change.

2. An electrophotographic process which comprises the generation of a latent image in an electronic printing MICR apparatus; thereafter developing the image with a toner composition comprised of resin particles, magnetite particles, a highly colored organic soluble dye, a colored organic insoluble dye, and an optional aliphatic hydrocarbon, or an additive component comprised of polymeric alcohol of the formula $$CH_3(CH_2)_nCH_2OH$$

wherein n is a number of from about 30 to about 500; and contacting the developed image with magnetic ink characters with a solvent thereby causing a permanent visible color change on said image, and wherein said dye is selected from the group consisting of Rhodamine red dye and Methylene Blue dye.

3. An electrophotographic process which consists essentially of the generation of a latent image in an electronic printing MICR apparatus; thereafter developing the image with a toner composition comprised of resin particles, magnetite particles, and a selected from the group consisting of Rhodamine Red dye and Methylene Blue dye; wherein alteration of the developed image with magnetic ink characters contacting the developed image with a solvent selected from the group consisting of methanol, ethanol, propanol, phenol, benzene, acetic acid, toluene, chloroform, Freons, and mixtures thereof thereby resulting in a permanent visible color change on said image.

4. A process in accordance with claim 2 wherein the dye is present in an amount of from about 0.3 to about 1 weight percent based on the weight of the toner.

5. A process in accordance with claim 2 wherein the magnetite particles are present in an amount of from about 30 to about 70 percent by weight.

6. A process in accordance with claim 2 wherein a soft roll fuser is selected for affixing the developed latent images.

7. A process in accordance with claim 3 wherein n is a number of from about 30 to about 300.

8. A process in accordance with claim 3 wherein the polymeric alcohol wax has a number average molecular weight of from about 475 to about 1,400.

9. A process in accordance with claim 3 wherein the polymeric alcohol is present as an internal component.

10. A process in accordance with claim 3 wherein the polymeric alcohol is present in an amount of from about 1 percent by weight to about 20 percent by weight.

11. A process in accordance with claim 1 wherein the resin particles are selected from the group consisting of polyesters, styrene butadiene copolymers, styrene acrylate copolymers, and styrene methacrylate copolymers.

12. A process in accordance with claim 11 wherein the styrene butadiene copolymer contains 91 percent by weight of styrene, and 9 percent by weight of butadiene.

13. A process in accordance with claims 11 wherein the magnetite is present in an amount of from about 30 to about 70 percent by weight.

14. A process in accordance with claim 11 wherein the magnetite is acicular and is present in an amount of from about 15 to about 40 percent by weight.

15. A process in accordance with claim 2 wherein the magnetite is cubic and is present in an amount of from about 50 to about 60 percent by weight.

16. A process in accordance with claim 1 wherein the toner composition contains a charge enhancing additive.

17. A process in accordance with claim 16 wherein the charge enhancing additive is selected from the group consisting of distearyl dimethyl ammonium methylsulfate, cetyl pyridinium halides, and stearyl phenethyl dimethyl ammonium tosylates.

18. A process in accordance with claim 16 wherein the charge enhancing additive is selected from the group consisting of Spilon TRH, and a potassium tetraphenyl borate.

19. A process in accordance with claim 16 wherein the charge enhancing additive is present in an amount of from about 0.05 percent by weight to about less than 5 percent by weight.

20. A process for processing personal checks which consists essentially of generating images in an electronic printing device; developing the images with a developer composition comprised of a toner comprised of resin particles having dispersed therein magnetite particles, a highly colored dye selected from the group consisting of Rhodamine red dye and Methylene Blue dye and as an optional component a polymeric alcohol of the formula $$CH_3(CH_2)_nCH_2OH$$

wherein n is a number of from about 30 to about 500, and carrier particles; transferring the images to a substrate; fusing the images thereto; contacting the developed fused images with a solvent thereby resulting in a permanent visible color change on said image.

21. A process for processing personal checks which comprises generating images in an electronic printing device; developing the images with a developer composition comprised of a toner comprised of resin particles having dispersed therein magnetite particles, and highly colored dyes selected from the group consisting of Rhodamine red dye and Methylene Blue dye and carrier particles; transferring the images to a substrate; fusing the images thereto; and contacting the developed images with magnetic ink characters thereon with a solvent thereby resulting in a permanent visible color change on said images.

22. A xerographic process which comprises generating latent images with high or low speed electronic printing devices; thereafter developing the image with a developer composition comprised of a toner composition comprised of resin particles, magnetite particles, and an organic soluble dye as selected from the group consisting of Rhodamine Red dye and Methylene Blue dye; and carrier particles; contacting the developed images with a solvent thereby resulting in a permanent visible color change on said images.

23. A process in accordance with claim 22 wherein the carrier particles contain a polymeric coating thereover.

24. A process in accordance with claim 23 wherein the carrier particles are comprised of a steel or a ferrite core with a coating thereover selected from the group consisting of trifluorochloroethylene-covinylchloride copolymer, a polyvinylidene fluoropolymer, or a terpolymer of styrene, methacrylate, and an organo silane, fluorinated ethylenepropylene copolymers, and polytetrafluoroethylene.

25. A process in accordance with claim 22 wherein the toner contains a charge enhancing additive.

26. A process in accordance with claim 25 wherein the charge enhancing additive is distearyl dimethyl ammonium methyl sulfate.

27. A process which comprises the formation of a latent image on a photoconductive member in an electronic imaging apparatus; developing the image with a toner composition comprised of resin particles having dispersed therein magnetite particles, and a colored dye selected from the group consisting of Congo Red, Induline 6B Cl 860, Celliton Fast Yellow 7G, Cyanine Cl 806, Pinacyanol Cl 808, Meldola's Blue Cl 909, Toluylene Blue Cl 820, Methylene Green B Cl 924, Paraosaniline Cl 676, Rhodamine 3GO, Brilliant Milling Green B Cl 667, Scarlet Cl 1034, Algol Brilliant Green BK, and Quinoline Yellow O Cl 801; subsequently transferring the image to a supporting substrate; fixing the image; and subsequently contacting the image with a solvent thereby resulting in permanent staining of the said image.

28. A process in accordance with claim 27 wherein the solvent is selected from the group consisting of ketones, ethers, alcohols, and aromatic solvents.

29. A process in accordance with claim 27 wherein the solvent is selected from the group consisting of methanol, ethanol, propanol, phenol, benzene, acetic acid, toluene, chloroform, Freons, and mixtures thereof.

30. A process in accordance with claim 27 wherein the image changes to a violet color.

31. An electrophotographic process for enabling substantially tamperproof images, which comprises the generation of a latent image; developing the image with a toner composition comprised of resin particles, magnetite particles, and a colored organic soluble dye or, a colored organic insoluble dye, which dye is selected from the group consisting of Rhodamine Red dye and Methylene Blue dye, and contacting the developed images with a solvent selected from the group consisting of methanol, ethanol, propanol, phenol, benzene, acetic acid, toluene, chloroform, Freons, and mixtures thereof thereby resulting in a permanent visible color change on said images.

32. An electrophotographic process for enabling substantially tamperproof images, which consists essentially of the generation of a latent image; developing the image with a toner composition comprised of resin particles, magnetite particles, and a colored organic soluble dye selected from the group consisting of Rhodamine Red dye and Methylene Blue dye; and an optional additive component comprised of an aliphatic hydrocarbon or a polymeric alcohol of the formula $$CH_3(CH_2)_nCH_2OH$$

wherein n is a number of from about 30 to about 500, and contacting the developed images with a solvent thereby resulting in a permanent visible color change on said image.

33. A process in accordance with claim 20 wherein the dye is Rhodamine Red dye.

34. A process in accordance with claim 22 wherein the dye is Rhodamine Red dye.

35. A process in accordance with claim 27 wherein the dye is Rhodamine Red dye.

36. A process in accordance with claim 32 wherein the dye is Rhodamine Red dye.

37. A process in accordance with claim 31 wherein the dye is Rhodamine Red dye.

* * * * *